US009282611B2

(12) United States Patent
Chu et al.

(10) Patent No.: US 9,282,611 B2
(45) Date of Patent: Mar. 8, 2016

(54) LED DRIVING APPARATUS AND OPERATING METHOD THEREOF

(71) Applicant: Raydium Semiconductor Corporation, Hsinchu (TW)

(72) Inventors: Chih-Wei Chu, New Taipei (TW); Yu-En Lee, New Taipei (TW); Shu-Kuang Chou, New Taipei (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 135 days.

(21) Appl. No.: 14/085,586

(22) Filed: Nov. 20, 2013

(65) Prior Publication Data

US 2014/0145629 A1 May 29, 2014

(30) Foreign Application Priority Data

Nov. 23, 2012 (TW) ..... 101143983 A

(51) Int. Cl.
*H05B 33/08* (2006.01)

(52) U.S. Cl.
CPC ..... *H05B 33/0854* (2013.01); *H05B 33/083* (2013.01)

(58) Field of Classification Search
None
See application file for complete search history.

(56) References Cited

U.S. PATENT DOCUMENTS

| | | | | |
|---|---|---|---|---|
| 8,035,313 | B2 * | 10/2011 | Wendt | H05B 33/0818 315/169.3 |
| 8,232,740 | B2 * | 7/2012 | Huang | 315/294 |
| 8,324,840 | B2 * | 12/2012 | Shteynberg | H05B 33/083 315/185 R |
| 8,653,742 | B2 * | 2/2014 | Kikuchi | H05B 33/0818 315/209 R |
| 9,041,302 | B2 * | 5/2015 | van de Ven | H05B 33/0809 315/188 |
| 2013/0069535 | A1 * | 3/2013 | Athalye | 315/121 |
| 2014/0125228 | A1 * | 5/2014 | Chu et al. | 315/113 |

* cited by examiner

*Primary Examiner* — Alexander H Taningco
*Assistant Examiner* — Nelson Correa

(57) ABSTRACT

A LED driving apparatus and an operating method thereof are disclosed. The LED driving apparatus includes a power, at least one LED string, a LED control unit, and an input voltage detection circuit. At least one LED string is coupled to the power and includes LEDs connected in series. The input voltage detection circuit is coupled to two ends of at least one LED of the LEDs respectively and used to judge whether an input voltage is lower than a LED conducting voltage. The input voltage detection circuit includes a charging capacitance to be charged when the at least one LED string is conducted. If the judged result of the input voltage detection circuit is yes, the input voltage detection circuit will control the charging capacitance having a charging voltage to discharge to the at least one LED string.

8 Claims, 7 Drawing Sheets

LED DRIVING APPARATUS AND OPERATING METHOD THEREOF

CROSS-REFERENCE TO RELATED APPLICATION

This non-provisional application claims priority under 35 U.S.C. §119(a) on Patent Application No. 101143983 filed in Taiwan R.O.C. on Nov. 23, 2012, the entire contents of which are hereby incorporated by reference.

BACKGROUND OF THE INVENTION

1. Field of the Invention

The invention relates to the driving of a light-emitting diode (LED); in particular, to an AC-to-DC LED driving apparatus for illumination and operating method thereof.

2. Description of the Prior Art

Recently, LED has been widely used in many applications. In a conventional linear LED driving circuit, no matter single segment driving or multiple segments driving is used, when the input voltage is smaller than a forward voltage of the LED, the current passing through the LED will be zero. In order to reach average current having best illumination efficiency, the LED current should be increased and the power and temperature will be also increased.

If a LED string has a first light-emitting diode, a second light-emitting diode, and a third light-emitting diode coupled in series, as shown in FIG. 1, in the periods of ΔT1, ΔT2, and ΔT3, a first LED current $I_{LED1}$, a second LED current $I_{LED2}$, and a third LED current $I_{LED3}$ are zero respectively. Because the first LED current $I_{LED1}$, the second LED current $I_{LED2}$, and the third LED current $I_{LED3}$ are all zero in the period of ΔT1, it means that the first light-emitting diode LED1, the second light-emitting diode LED2, and the third light-emitting diode LED3 fail to illuminate in the period of ΔT1, so that the LED string will generate flicker of 120 Hz.

Therefore, the invention provides a LED driving apparatus and operating method thereof to solve the above-mentioned problems occurred in the prior arts.

SUMMARY OF THE INVENTION

An embodiment of the invention is a LED driving apparatus. In this embodiment, the LED driving apparatus includes a power, at least one LED string, a LED control unit, and an input voltage detection circuit. The at least one LED string is coupled to the power and includes a plurality of LEDs coupled in series. The LED control unit is coupled to the at least one LED string and used for controlling the operation of the plurality of LEDs.

The input voltage detection circuit is coupled to two ends of at least one LED of the plurality of LEDs respectively and used to judge whether an input voltage is lower than a LED conducting voltage. The input voltage detection circuit includes a charging capacitance to be charged when the at least one LED string is conducted. If the judged result of the input voltage detection circuit is yes, the input voltage detection circuit will control the charging capacitance having a charging voltage to discharge to the at least one LED string.

Another embodiment of the invention is a method of operating a LED driving apparatus. In this embodiment, the LED driving apparatus includes a power, at least one LED string, a LED control unit, and an input voltage detection circuit. The at least one LED string includes a plurality of LEDs coupled in series. The input voltage detection circuit is coupled to two ends of at least one LED of the plurality of LEDs respectively.

The method includes steps of: (a) the LED control unit controlling the operation of the plurality of LEDs; (b) the input voltage detection circuit judging whether an input voltage is lower than a LED conducting voltage; (c) if the judged result of the input voltage detection circuit is yes, the input voltage detection circuit will control the charging capacitance having a charging voltage to discharge to the at least one LED string.

Compared to the prior art, the LED driving apparatus and the LED driving apparatus operating method of the invention can detect whether an input voltage is lower than a LED conducting voltage through the input voltage detection circuit, if yes, the charging capacitance having a charging voltage will be controlled to discharge to a part of the LEDs, so that there is still some current passing through the part of the LEDs and the part of the LEDs will continuously illuminate instead of no LED illuminating during certain period of time as prior art. Therefore, the LED driving apparatus of the invention can effectively improve the flicker occurred in the LED string of the prior art and enhance the illumination efficiency of the LED string in every AC cycle.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

An embodiment of the invention is a LED driving apparatus. In this embodiment, the LED driving apparatus can be an AC-to-DC LED driver for illumination, but not limited to this.

Figure 1:
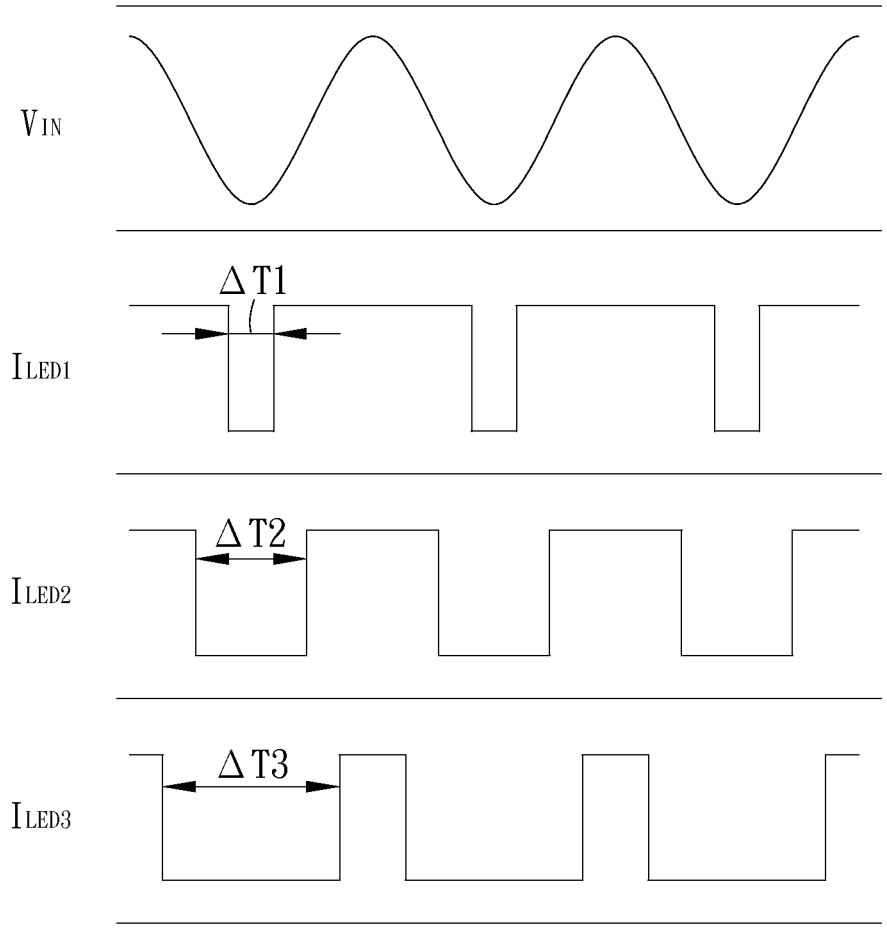
FIG. 1 (PRIOR ART)
FIG. 1 illustrates a timing diagram of the LED currents of the first LED, the second LED, and the third LED coupled in series in the LED string of the prior art.
Figure 2:
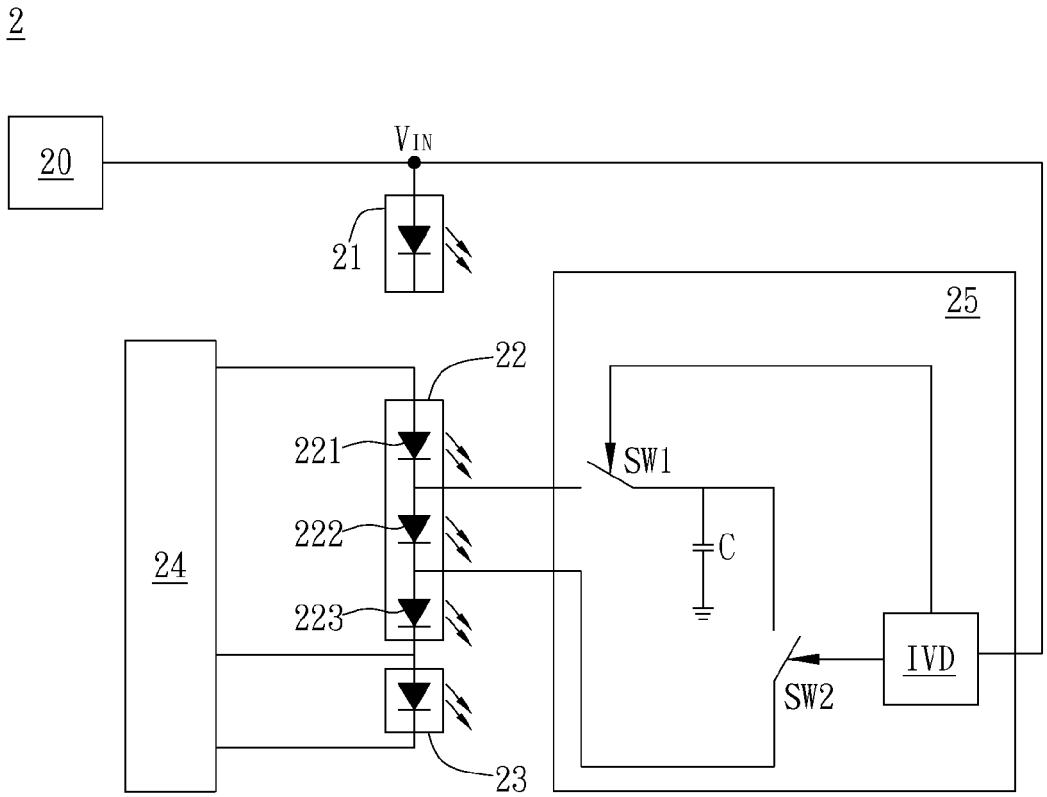
FIG. 2 illustrates a schematic diagram of the LED driving apparatus in an embodiment of the invention.

Please refer to FIG. 2. FIG. 2 illustrates a schematic diagram of the LED driving apparatus in this embodiment. As shown in FIG. 2, the LED driving apparatus 2 includes a power 20, a first LED string 21, a second LED string 22, a third LED string 23, a LED control unit 24, and an input voltage detection circuit 25. The input voltage detection circuit 25 includes a first switch SW1, a second switch SW2, a charging capacitance C, and an input voltage detection unit IVD. In fact, the power 20 can be an AC power, and the number of the LED strings of the LED driving apparatus 2 can be determined based on practical needs.

Wherein, the first LED string 21, the second LED string 22, and the third LED string 23 are coupled in series. The power 20 is coupled to the first LED string 21. The LED control unit 24 is coupled between the first LED string 21 and the second LED string 22, between the second LED string 22 and the third LED string 23, and coupled to another end of the third LED string 23.

If the second LED string 22 includes a first LED 221, a second LED 222, and a third LED 223, the first switch SW1 can be coupled between the first LED 221 and the second LED 222 of the second LED string 22, and the second switch SW2 can be coupled between the second LED 222 and the third LED 223 of the second LED string 22. That is to say, the first switch SW1 and the second switch SW2 are coupled to two end of the second LED 222 of the second LED string 22 respectively. The first switch SW1 and the second switch SW2 are coupled, and one end of the charging capacitance C is coupled to the ground and another end of the charging capacitance C is coupled between the first switch SW1 and the second switch SW2. The input voltage detection unit IVD is coupled to the first switch SW1 and the second switch SW2 respectively.

It should be noticed that the first switch SW1 coupled between the first LED 221 and the second LED 222 and the second switch SW2 coupled between the second LED 222 and the third LED 223 disclosed in this embodiment is only a coupling way of the application. In fact, the first switch SW1 and the second switch SW2 can be coupled to other LEDs based on practical needs.

In this embodiment, no matter the LEDs are driven by a single segment driving way or a multiple segments driving way, when the first LED string 21 and the first LED 221 of the second LED string 22 are conducted, the first switch SW1 is turned on and the second switch SW2 is turned off; therefore, the LED current flowing through the first LED string 21 and the first LED 221 of the second LED string 22 will flow through the turned-on first switch SW1 and enter into the charging capacitance C to charge the charging capacitance C.

Once the input voltage detection unit IVD detects that the input voltage $V_{IN}$ is lower than the LED conducting voltage, the input voltage detection unit IVD will output switch control signals to the first switch SW1 and the second switch SW2 respectively to turn off the first switch SW1 and turn on the second switch SW2. At this time, if the charging capacitance C has a capacitance voltage after being charged, the capacitance voltage can discharge the third LED 223 of the second LED string 22 and the third LED string 23 through the second switch SW2, so that there is still some current passing through the part of the LEDs and the part of the LEDs will continuously illuminate instead of no LED illuminating during certain period of time as prior art. Therefore, the LED driving apparatus 2 of the invention can effectively improve the flicker occurred in the LED string of the prior art and enhance the illumination efficiency of the LED string in every AC cycle.

Figure 3:
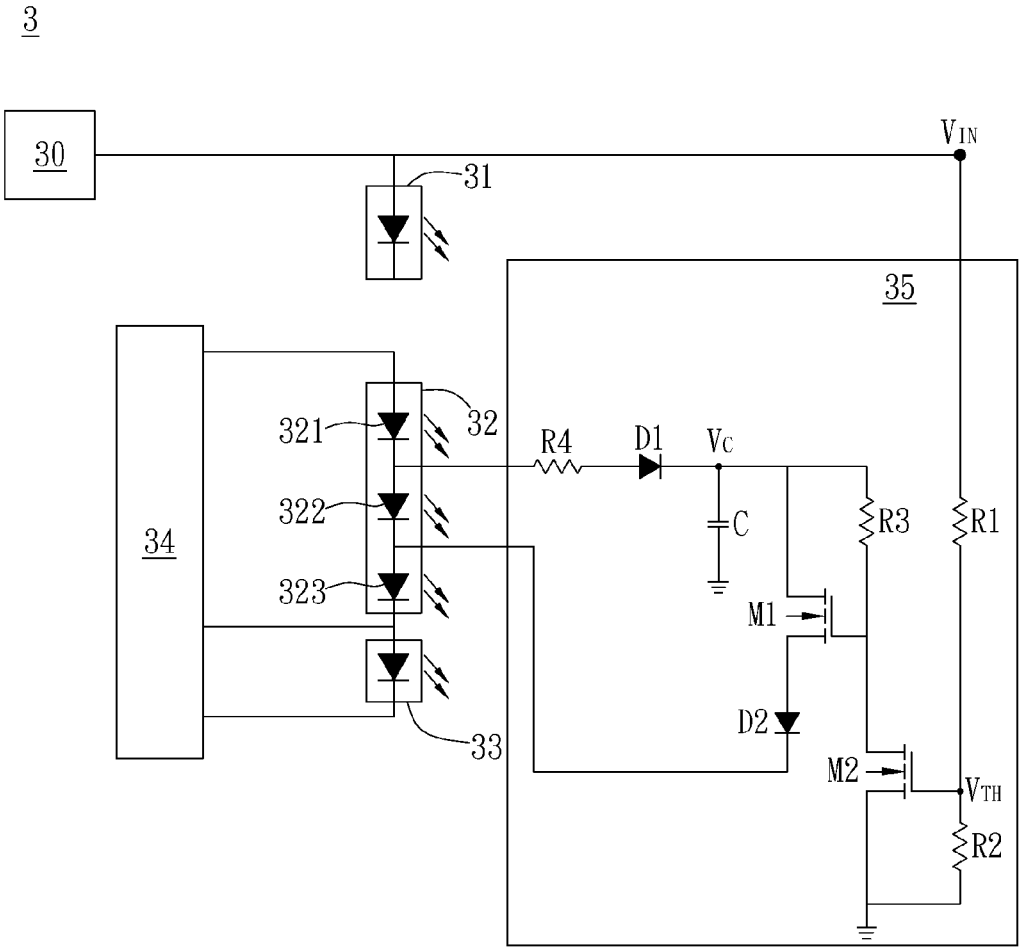
FIG. 3 illustrates a schematic diagram of the LED driving apparatus in another embodiment of the invention.

Then, Please refer to FIG. 3. FIG. 3 illustrates a schematic diagram of the LED driving apparatus in another embodiment of the invention. As shown in FIG. 3, the LED driving apparatus 3 includes a power 30, a first LED string 31, a second LED string 32, a third LED string 33, a LED control unit 34, and an input voltage detection circuit 35. The input voltage detection circuit 35 includes a first resistor R1~a fourth resistor R4, a first transistor M1, a second transistor M2, a first diode D1, a second diode D2, and a charging capacitance C.

Wherein, the first LED string 31, the second LED string 32, and the third LED string 33 are coupled in series. The power 30 is coupled to the first LED string 31. The LED control unit 34 is coupled between the first LED string 31 and the second LED string 32, between the second LED string 32 and the third LED string 33, and coupled to another end of the third LED string 33 respectively.

If the second LED string 32 includes a first LED 321, a second LED 322, and a third LED 323, one end of the first transistor M1 can be coupled to a node between the first LED 321 and the second LED 322 of the second LED string 32 through the first diode D1 and the fourth resistor R4; another end of the first transistor M1 is coupled to another node between the second LED 322 and the third LED 323 of the second LED string 32 through the second diode D2; the gate of the first transistor M1 is coupled between the third resistor R3 and the second transistor M2.

The second transistor M2 is coupled between the third resistor R3 and the ground, and the gate of the second transistor M2 is coupled between the first resistor R1 and the second resistor R2. One end of the first resistor R1 is coupled to the power 30 and the first LED string 31; another end of the first resistor R1 is coupled to the second resistor R2; the second resistor R2 is coupled between the first resistor R1 and the ground. One end of the third resistor R3 is coupled to the gate of the first transistor M1 and the second transistor M2, and another end of the third resistor R3 is coupled to the first transistor M1 and the first diode D1.

When the first LED string 31 and the first LED 321 of the second LED string 32 are conducted, if the divided voltage $V_{TH}$ between the first resistor R1 and the second resistor R2 is larger than or equal to the conduction voltage of the second transistor M2, the second transistor M2 will be turned on and the gate of the first transistor M1 will be pull to lower voltage level, and the first transistor M1 will be turned off. At this time, the LED current flowing through the first LED string 31 and the first LED 321 of the second LED string 32 will charge the charging capacitance C through the fourth resistor R4 and the first diode D1.

Because the divided voltage $V_{TH}$ between the first resistor R1 and the second resistor R2 is a divided voltage of the input voltage $V_{IN}$, when the input voltage $V_{IN}$ decreases, the divided voltage $V_{TH}$ will also decrease. In addition, because the divided voltage $V_{TH}$ is also the gate voltage of the second transistor M2, if the divided voltage $V_{TH}$ is smaller than the conduction voltage of the second transistor M2, the second transistor M2 will be turned off, and the gate of the first transistor M1 will be pull to high voltage level through the third resistor R3 to turn on the first transistor M1, and the first diode D1 is turned off due to a cut-off reverse-bias.

Figure 4:
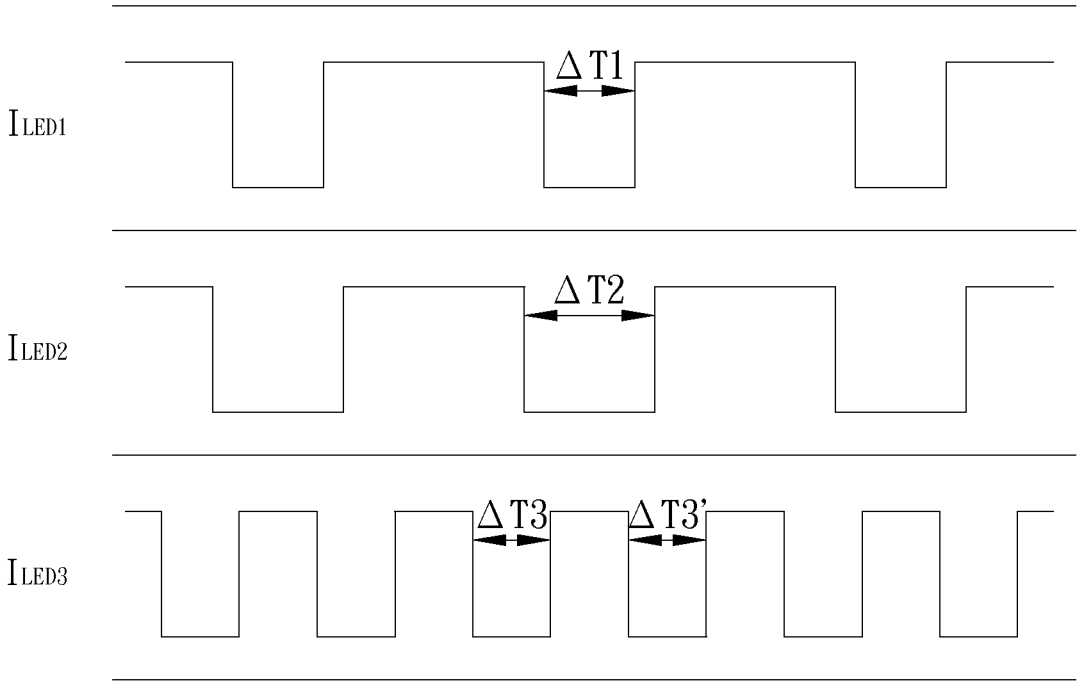
FIG. 4 illustrates a timing diagram of the LED currents of the first LED, the second LED, and the third LED coupled in series in the LED string of the invention.

If the charging capacitance C has a charging voltage Vc after being charged, the charges of the charging voltage Vc will discharge to the third LED 323 of the second LED string 32 and the third LED string 33 through the first transistor M1 and the second diode D2, so that a part of the LED string can still illuminate in a period that the input voltage $V_{IN}$ is smaller than the conduction voltage of the LED string (as the third LED current $I_{LED3}$ shown in FIG. 4) instead of no LED illuminating during certain period of time as prior art. Therefore, the LED driving apparatus 3 of the invention can effectively improve the flicker occurred in the LED string of the prior art and enhance the illumination efficiency of the LED string in every AC cycle.

Another embodiment of the invention is a method of operating a LED driving apparatus. In this embodiment, the LED driving apparatus includes a power, at least one LED string, a LED control unit, and an input voltage detection circuit. The at least one LED string includes a plurality of LEDs coupled in series. The input voltage detection circuit is coupled to two ends of at least one LED of the plurality of LEDs respectively, wherein a second voltage of the second end is lower than a first voltage of the first end.

Figure 5:
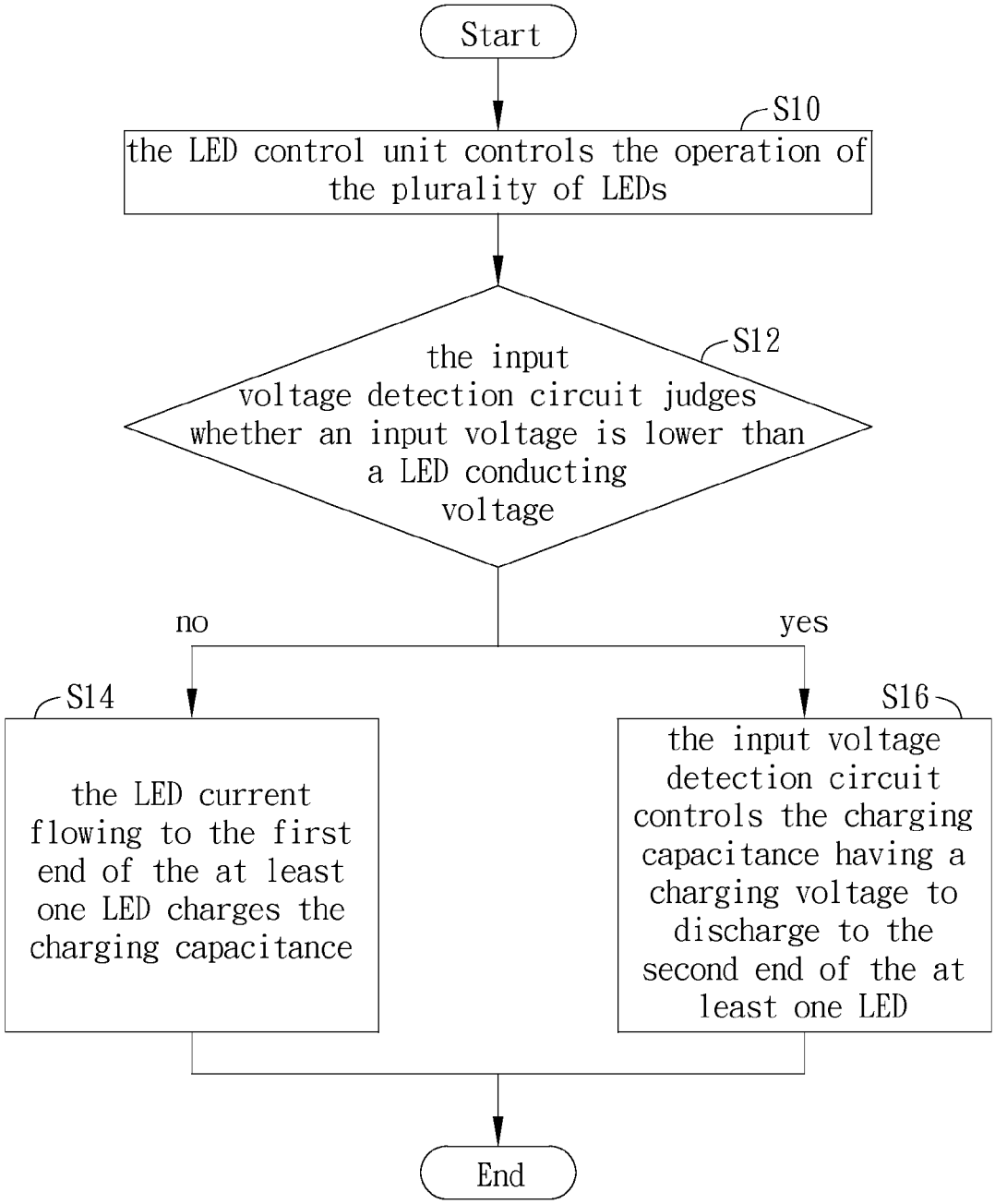
FIG. 5 illustrates a flow chart of the LED driving apparatus operating method in another embodiment of the invention.

Please refer to FIG. 5. FIG. 5 illustrates a flow chart of the LED driving apparatus operating method in this embodiment.

As shown in FIG. 5, at first, in the step S10, the LED control unit controls the operation of the plurality of LEDs. Then, in the step S12, the input voltage detection circuit judges whether an input voltage is lower than a LED conducting voltage.

If the judged result of the step S12 is no, the method performs the step S14, the LED current flowing to the first end of the at least one LED charges the charging capacitance. If the judged result of the step S12 is yes, the method performs the step S16, the input voltage detection circuit controls the charging capacitance having a charging voltage to discharge to the second end of the at least one LED.

Figure 6:
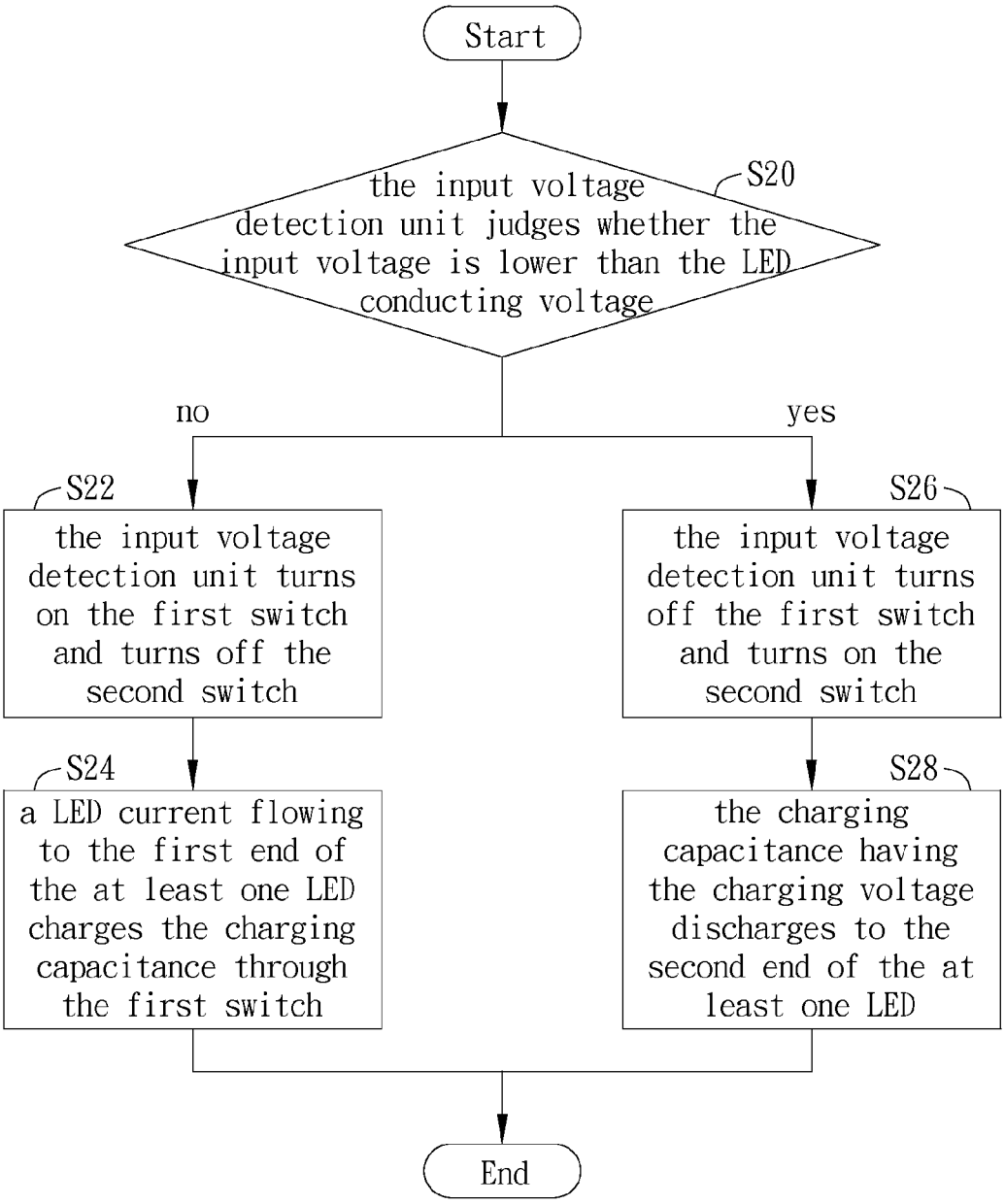
FIG. 6 illustrates a flow chart of the LED driving apparatus operating method in another embodiment of the invention.

In an embodiment, the input voltage detection circuit includes a first switch, a second switch, and an input voltage detection unit. The first switch is coupled to a first end of the at least one LED and the charging capacitance, the second switch is coupled to a second end of the at least one LED and the first switch. As shown in FIG. 6, in the step S20, the input voltage detection unit judges whether the input voltage is lower than the LED conducting voltage.

If the judged result of the step S20 is no, the method performs the step S22, the input voltage detection unit turns on the first switch and turns off the second switch. In the step S24, a LED current flowing to the first end of the at least one LED charges the charging capacitance through the first switch.

If the judged result of the step S20 is yes, the method performs the step S26, the input voltage detection unit turns off the first switch and turns on the second switch. In the step S28, the charging capacitance having the charging voltage discharges to the second end of the at least one LED, so that a part of the plurality of LEDs having voltages lower than a voltage at the second end of the at least one LED can be turned on to illuminate.

In another embodiment, the input voltage detection circuit further includes a first resistor, a second resistor, a third resistor, a fourth resistor, a first diode, a second diode, a first transistor, and a second transistor. The fourth resistor is coupled to a first end of the at least one LED; the second diode is coupled to a second end of the at least one LED. A second voltage of the second end is lower than a first voltage of the first end. A gate of the second transistor is coupled between the first resistor and the second resistor. A gate of the first transistor is coupled between the third resistor and the second transistor.

Figure 7:
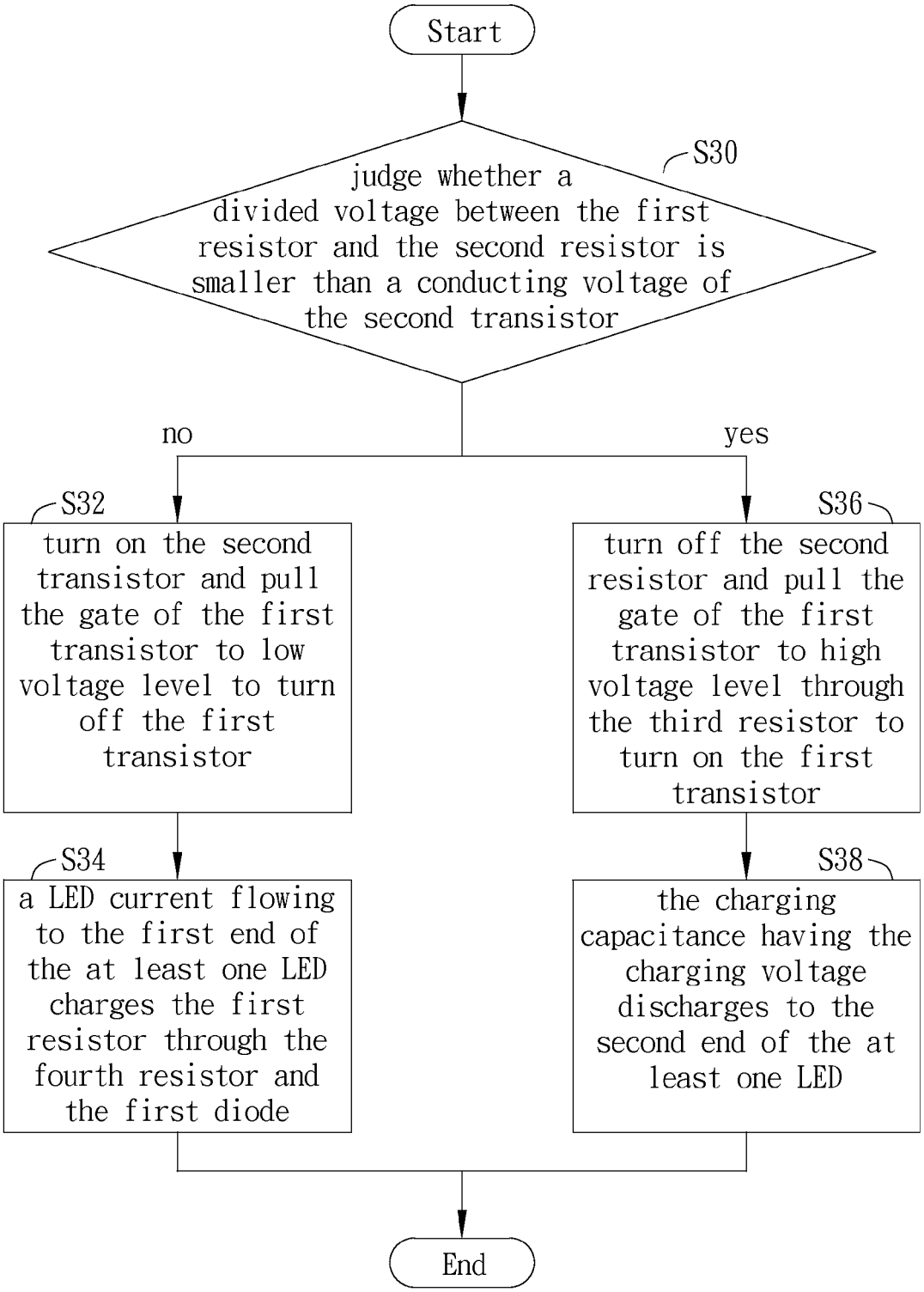
FIG. 7 illustrates a flow chart of the LED driving apparatus operating method in another embodiment of the invention.

As shown in FIG. 7, in the step S30, the method judges whether a divided voltage between the first resistor and the second resistor is smaller than a conducting voltage of the second transistor. If the judged result of the step S30 is no, the method performs the step S32 to turn on the second transistor and pull the gate of the first transistor to low voltage level to turn off the first transistor. In the step S34, a LED current flowing to the first end of the at least one LED charges the first resistor through the fourth resistor and the first diode.

If the judged result of the step S30 is yes, the method performs the step S36 to turn off the second resistor and pull the gate of the first transistor to high voltage level through the third resistor to turn on the first transistor, and the first diode is turned off due to a cut-off reverse-bias. In the step S38, the charging capacitance having the charging voltage discharges to the second end of the at least one LED, so that a part of the plurality of LEDs having voltages lower than a voltage at the second end of the at least one LED will be turned on to illuminate.

Compared to the prior art, the LED driving apparatus and the LED driving apparatus operating method of the invention can detect whether an input voltage is lower than a LED conducting voltage through the input voltage detection circuit, if yes, the charging capacitance having a charging voltage will be controlled to discharge to a part of the LEDs, so that there is still some current passing through the part of the LEDs and the part of the LEDs will continuously illuminate instead of no LED illuminating during certain period of time as prior art. Therefore, the LED driving apparatus of the invention can effectively improve the flicker occurred in the LED string of the prior art and enhance the illumination efficiency of the LED string in every AC cycle.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A light-emitting diode (LED) driving apparatus, comprising:

a power;

at least one LED string, coupled to the power and comprising a plurality of LEDs coupled in series;

a LED control unit, coupled to the at least one LED string, for controlling the operation of the plurality of LEDs; and an input voltage detection circuit, coupled to two ends of at least one LED of the plurality of LEDs respectively and used for judging whether an input voltage is lower than a LED conducting voltage, the input voltage detection circuit comprising:

a charging capacitance to be charged when the at least one LED string is conducted;

a first switch, coupled to a first end of the at least one LED and the charging capacitance;

a second switch, coupled to a second end of the at least one LED and the first switch, wherein a second voltage of the second end is lower than a first voltage of the first end; and an input voltage detection unit, coupled to the first switch and the second switch respectively, for judging whether the input voltage is lower than the LED conducting voltage;

wherein if the judged result of the input voltage detection circuit is yes, the input voltage detection circuit will control the charging capacitance having a charging voltage to discharge to the at least one LED string.

2. The LED driving apparatus of claim 1, wherein if the judging result of the input voltage detection unit is no, the input voltage detection unit turns on the first switch and turns off the second switch, a LED current flowing to the first end of the at least one LED will charge the charging capacitance through the first switch; if the judging result of the input voltage detection unit is yes, the input voltage detection unit turns off the first switch and turns on the second switch, the charging capacitance having the charging voltage will discharge to the second end of the at least one LED, so that a part of the plurality of LEDs having voltages lower than a voltage at the second end of the at least one LED will be turned on to illuminate.

3. A light-emitting diode (LED) driving apparatus, comprising:

a power;

at least one LED string, coupled to the power and comprising a plurality of LEDs coupled in series;

a LED control unit, coupled to the at least one LED string, for controlling the operation of the plurality of LEDs; and an input voltage detection circuit, coupled to two ends of at least one LED of the plurality of LEDs respectively and used for judging whether an input voltage is lower than a LED conducting voltage, the input voltage detection circuit comprising:

a charging capacitance to be charged when the at least one LED string is conducted;

a first resistor, coupled to the power;

a second resistor, coupled between the first resistor and a ground;

a third resistor;

a fourth resistor, coupled to a first end of the at least one LED;

a first diode, coupled between the third resistor and the fourth resistor;

a second diode, coupled to a second end of the at least one LED, wherein a second voltage of the second end is lower than a first voltage of the first end;

a second transistor, one end of the second transistor coupled to the third resistor and another end of the second transistor coupled to the ground, a gate of the second transistor coupled between the first resistor and the second resistor; and a first transistor, one end of the first transistor coupled between the first diode and the third resistor and another end of the first transistor coupled to the second diode, a gate of the first transistor coupled between the third resistor and the second transistor;

wherein one end of the charging capacitance is coupled between the first diode and the third resistor and another end of the charging capacitance is coupled to the ground; and wherein if the judged result of the input voltage detection circuit is yes, the input voltage detection circuit will control the charging capacitance having a charging voltage to discharge to the at least one LED string.

4. The LED driving apparatus of claim 3, wherein when a divided voltage between the first resistor and the second resistor is larger than or equal to a conducting voltage of the second transistor, the second transistor is turned on, the first resistor is turned off because the gate of the first resistor is pull to a low voltage level, a LED current flowing to the first end of the at least one LED will charge the first resistor through the fourth resistor and the first diode.

5. The LED driving apparatus of claim 3, wherein when a divided voltage between the first resistor and the second resistor is smaller than a conducting voltage of the second transistor, the second transistor is turned off, the first resistor is turned on because the gate of the first resistor is pull to a high voltage level through the third resistor, the first diode is turned off due to a cut-off reverse-bias, the charging capacitance having the charging voltage will discharge to the second end of the at least one LED, so that a part of the plurality of LEDs having voltages lower than a voltage at the second end of the at least one LED will be turned on to illuminate.

6. A method of operating a light-emitting diode (LED) driving apparatus, the LED driving apparatus comprising a power, at least one LED string, a LED control unit, and an input voltage detection circuit, the at least one LED string comprising a plurality of LEDs coupled in series, the input voltage detection circuit being coupled to two ends of at least one LED of the plurality of LEDs respectively, the input voltage detection circuit comprising a first switch, a second switch, and an input voltage detection unit, the first switch coupled to a first end of the at least one LED and the charging capacitance, the second switch coupled to a second end of the at least one LED and the first switch, a second voltage of the second end lower than a first voltage of the first end, and the method comprising steps of:

(a) the LED control unit controlling the operation of the plurality of LEDs;

(b) the input voltage detection circuit judging whether an input voltage is lower than a LED conducting voltage;

(c) if a judged result of the input voltage detection circuit is yes, the input voltage detection circuit controlling a charging capacitance having a charging voltage to discharge to the at least one LED string; and (d) the input voltage detection unit judging whether the input voltage is lower than the LED conducting voltage.

7. The method of claim 6, further comprising steps of:

if the judging result of the input voltage detection unit is no, the input voltage detection unit turning on the first switch and turning off the second switch; and a LED current flowing to the first end of the at least one LED charging the charging capacitance through the first switch.

8. The method of claim 6, further comprising steps of:

if the judging result of the input voltage detection unit is yes, the input voltage detection unit turning off the first switch and turning on the second switch; and the charging capacitance having the charging voltage discharging to the second end of the at least one LED, so that a part of the plurality of LEDs having voltages lower than a voltage at the second end of the at least one LED will be turned on to illuminate.

* * * * *